US007223928B2

(12) United States Patent
Riopka et al.

(10) Patent No.: US 7,223,928 B2
(45) Date of Patent: May 29, 2007

(54) SWITCH WITH IMPROVED PROTECTION FROM ICE CONDITIONS

(75) Inventors: William W Riopka, Brampton (CA); Terrence S. Kerr, Guelph (CA)

(73) Assignees: S&C Electric Canada Ltd., Toronto, Ontario (CA); S&C Electric Company, Chicago, IL (US)

( * ) Notice: Subject to any disclaimer, the term of this patent is extended or adjusted under 35 U.S.C. 154(b) by 0 days.

(21) Appl. No.: 11/299,269

(22) Filed: Dec. 12, 2005

(65) Prior Publication Data

US 2006/0174638 A1 Aug. 10, 2006

Related U.S. Application Data

(60) Provisional application No. 60/637,158, filed on Dec. 20, 2004.

(51) Int. Cl.
*H01H 31/00* (2006.01)

(52) U.S. Cl. ..... 200/48 R; 200/48 P

(58) Field of Classification Search ..... 200/48 S, 200/48 P, 49, 48 CB, 48 R; 218/12, 14, 218/154; 361/822, 832, 8
See application file for complete search history.

(56) References Cited

U.S. PATENT DOCUMENTS 3,774,137 A * 11/1973 Carothers ..... 337/174
3,836,737 A * 9/1974 Redfern ..... 200/48 A
3,876,849 A * 4/1975 Jackson, Jr. ..... 200/253.1
4,049,933 A * 9/1977 Lovett ..... 200/48 R
4,296,284 A * 10/1981 Lott ..... 200/48 R
4,541,033 A * 9/1985 Saito ..... 361/602
4,688,013 A * 8/1987 Nishikawa ..... 337/168
5,532,668 A * 7/1996 Fennell ..... 337/168
5,670,927 A * 9/1997 Fennell ..... 337/168
6,459,053 B1 * 10/2002 Roberts ..... 200/48 R
6,541,717 B1 * 4/2003 Roberts ..... 200/43.11
6,946,607 B2 * 9/2005 Roberts ..... 200/48 R
2005/0127040 A1 * 6/2005 Franklin et al. ..... 218/12

* cited by examiner

*Primary Examiner*—Michael Friedhofer
*Assistant Examiner*—Lisa Klaus
(74) *Attorney, Agent, or Firm*—James V. Lapacek

(57) ABSTRACT

An arrangement is provided to protect an electrical switch from the deleterious effects of ice formation that inhibits switch operation. In a preferred arrangement, an ice shield is provided that protects the current-carrying contact structures and other operative elements of the switch from ice build-ups. In one specific arrangement, as the switch is moved from the open position to the closed position, the ice shield moves away from the contact structure of a moving contact of the switch to permit unfettered engagement with a stationary contact structure of the switch.

3 Claims, 4 Drawing Sheets

SWITCH WITH IMPROVED PROTECTION FROM ICE CONDITIONS

This application claims the benefit of U.S. Provisional Application No. 60/637,158 filed on Dec. 20, 2004.

BACKGROUND OF THE INVENTION

1. Field of the Invention

The present invention relates generally to the field of electrical switches for electrical power transmission and distribution, and more particularly to an arrangement to protect the switch from the deleterious effects of ice formation that inhibits switch operation.

2. Description of the Related Art

Outdoor electrical switches for the electrical power transmission and distribution field are subject to the deleterious effects of ice formation that can inhibit proper switch operation. These types of switches are tested under various icing conditions to determine whether or not they will operate properly during outdoor use in the field. In some cases, the opening and closing forces during switch operation are determined such as to permit the switch contact to break free from ice formations during the opening and closing operations.

While the prior art arrangements may be useful to provide switches with various features to permit operation under ice conditions, it would be desirable to provide enhanced protection from ice formations.

SUMMARY OF THE INVENTION

Accordingly, it is a principal object of the present invention to provide an arrangement to protect a switch from the deleterious effects of ice formation that inhibits switch operation. It is another object of the present invention to provide an ice shield that protects the current-carrying contact structures and other operative elements of a switch from ice buildups.

These and other objects of the present invention are efficiently achieved by the provision of an arrangement to protect an electrical switch from the deleterious effects of ice formation that inhibits switch operation. In a preferred arrangement, an ice shield is provided that protects the current-carrying contact structures and other operative elements of the switch from ice buildups. In one specific arrangement, as the switch is moved from the open position to the closed position, the ice shield moves away from the contact structure of a moving contact of the switch to permit unfettered engagement with a stationary contact structure of the switch.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
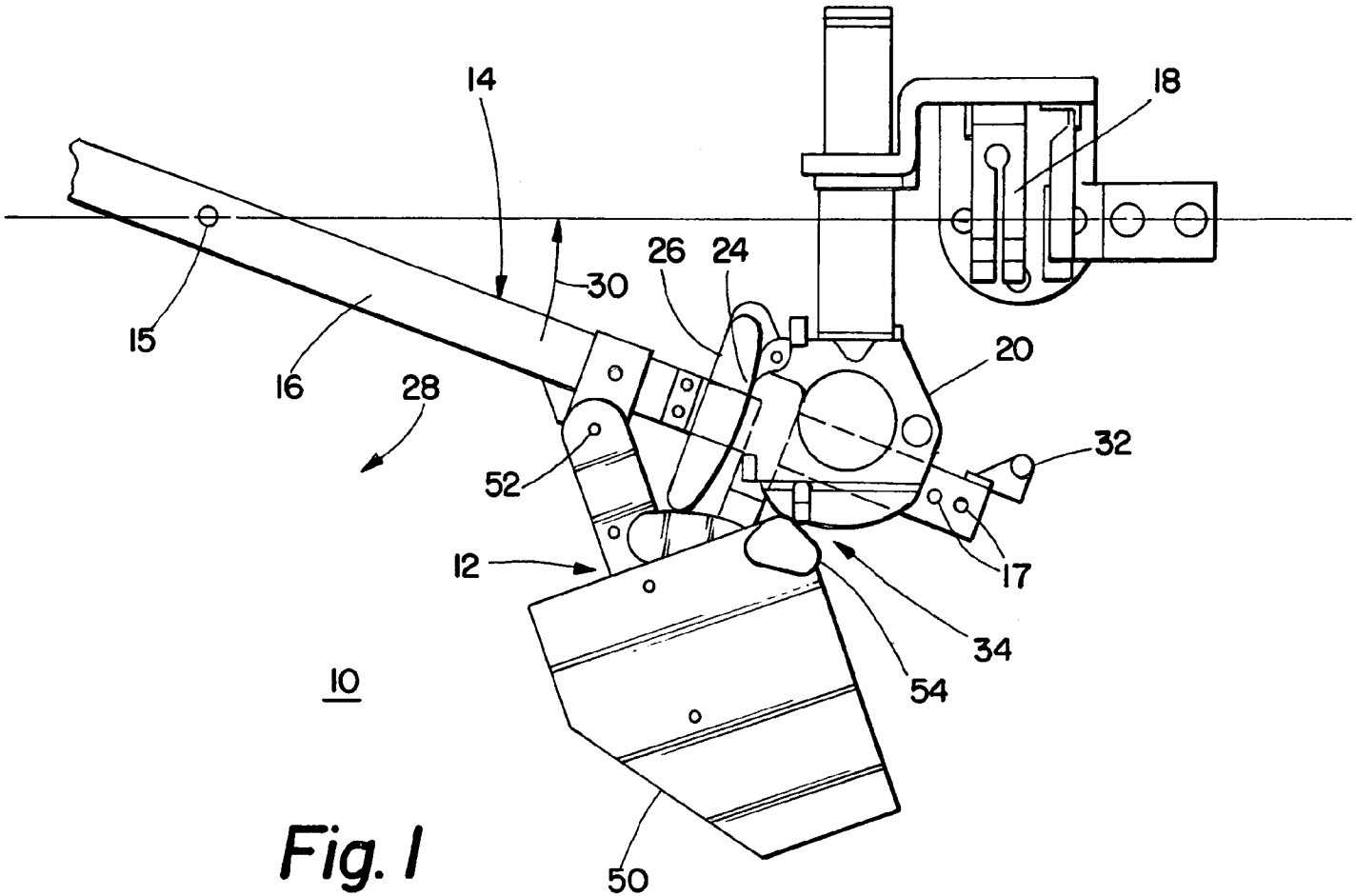
FIG. 1 is a top plan view of an illustrative electrical switch for use with the arrangement of the present invention to protect the switch from ice formation.
Figure 2:
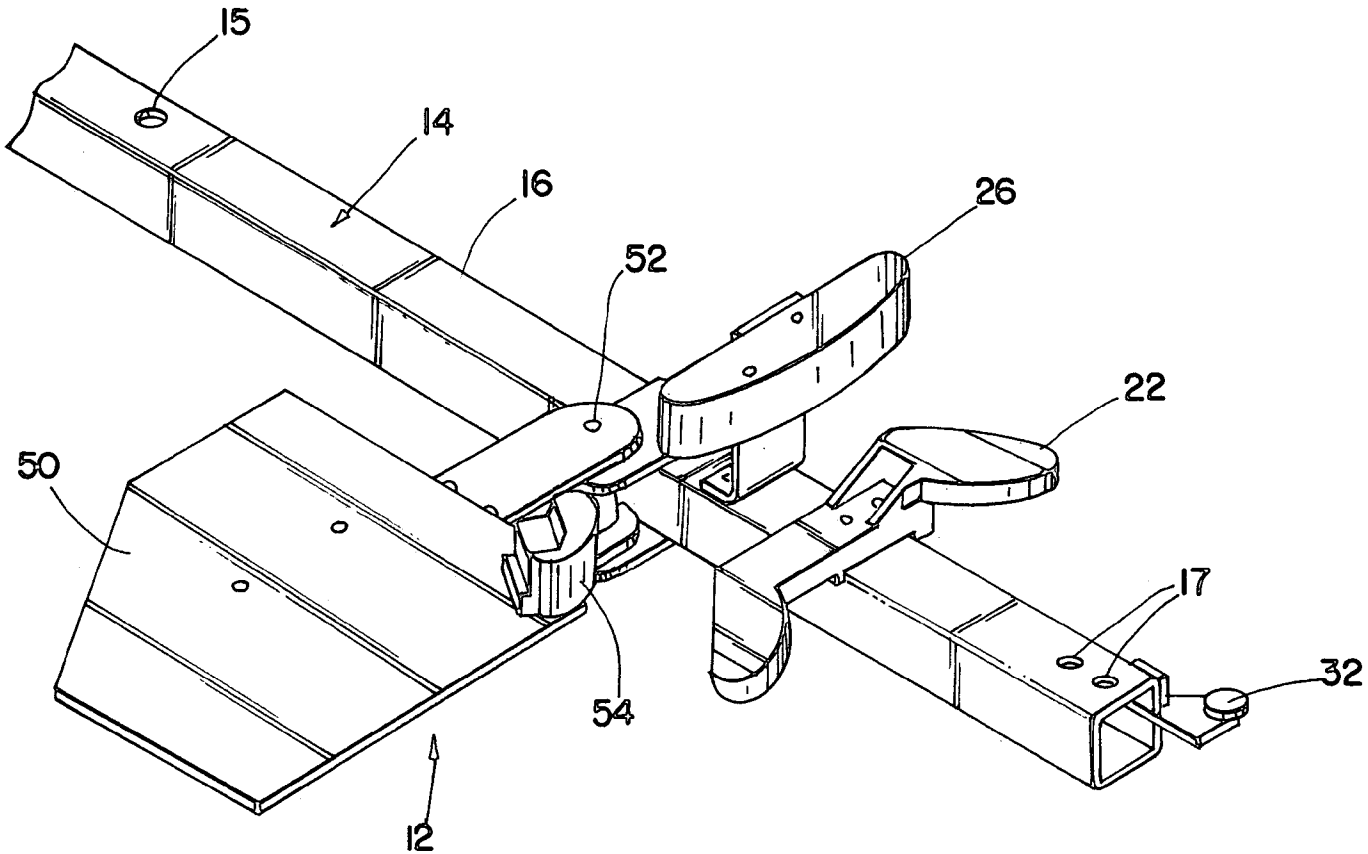
FIG. 2 is a perspective view of the arrangement of FIG. 1 illustrated in an open position corresponding to the closed operating position of the switch.
Figure 3:
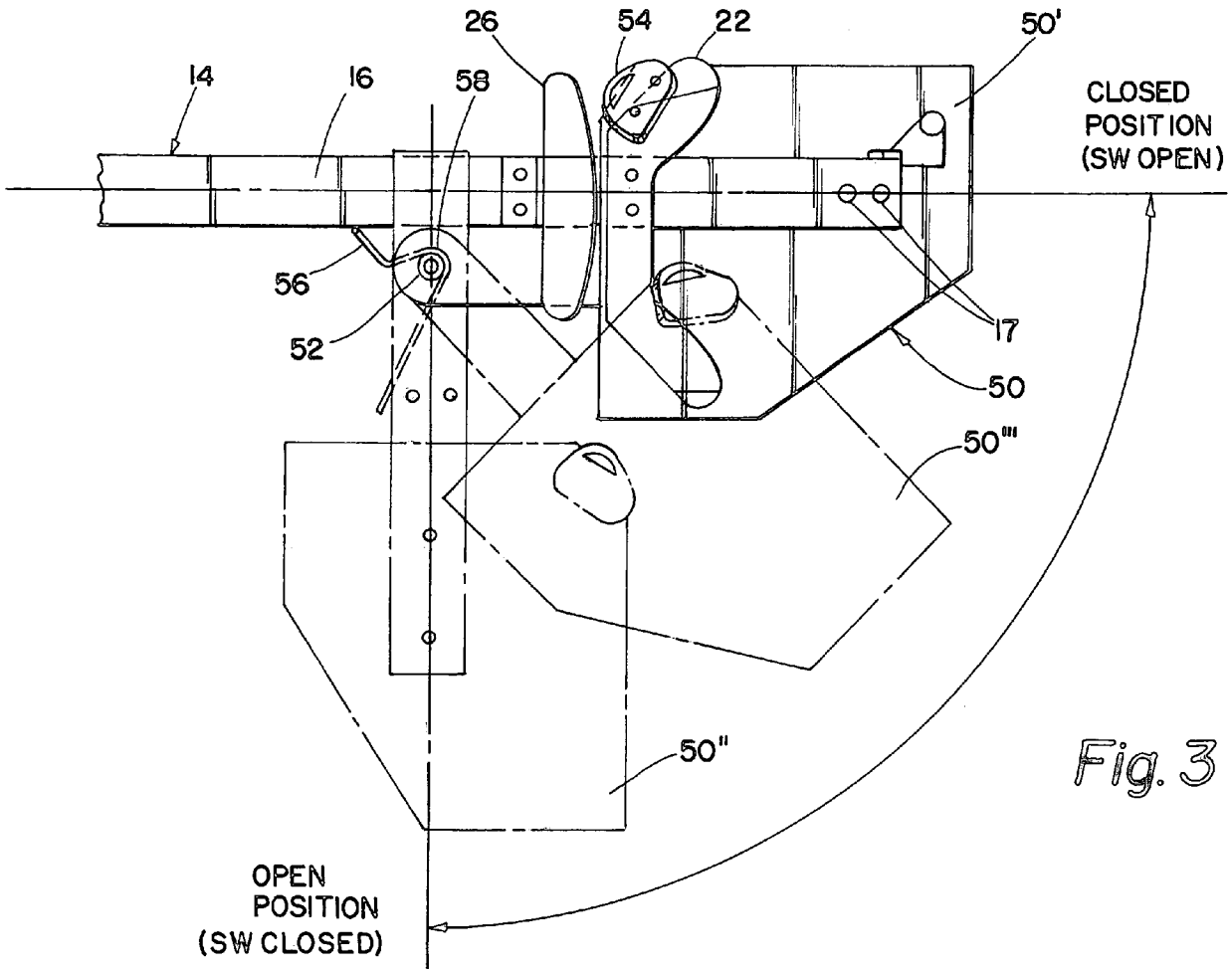
FIG. 3 is a plan view of the arrangement of FIG. 2 illustrating various operating positions of a movable ice shield of the present invention.
Figure 4:
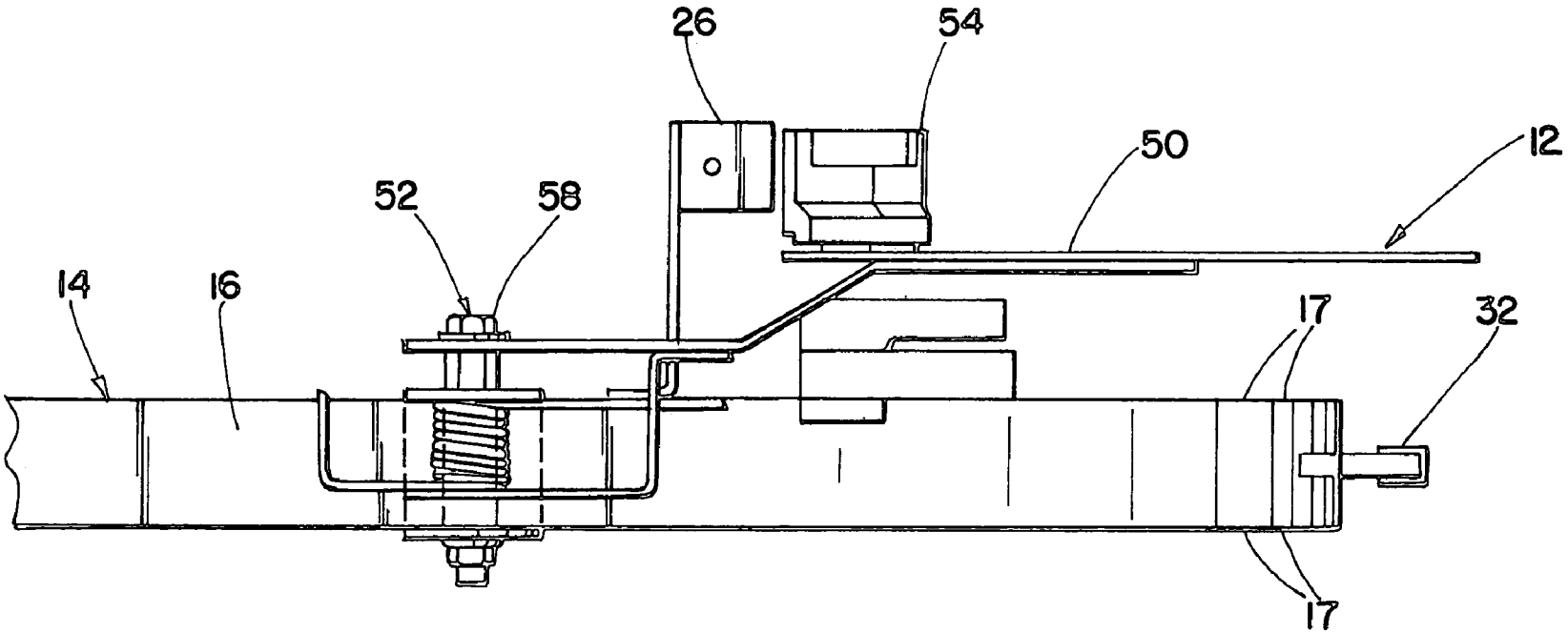
FIG. 4 is a front elevational view of the arrangement of FIG. 2 with the movable ice shield in a closed position corresponding to the open operating position of the switch.

The switch 10 of FIG. 1 is illustrative of one type of switch that is suitable for use with the ice-protection arrangement 12 of the present invention illustrated in more detail in FIGS. 2–4. This type of switch is useful in the electrical power distribution field and is of the type sold by S&C Electric Co., Chicago, Ill. and is of the general type shown in U.S. Pat. Nos. 4,126,773, 3,909,570, and 3,647,996. Referring now additionally to FIGS. 2–4, the switch 10 includes a moving contact structure 14 with a switch blade 16 arranged to pivot about a pivot point 15, a stationary contact structure 18 for engagement with a switch-blade contact portion 17 of the switch blade 16, and an interrupter 20.

The interrupter 20 includes internal interrupting contacts (not shown) that are actuated via an external trigger structure (not shown) during the interrupting stage of the switch operation via a switch-blade cam 22 (best seen in FIG. 2) on the moving contact structure 14 carried by the switch blade 16. Specifically, on opening of the switch 10 via movement of the switch blade 16 out of engagement with the stationary contact structure 18 and toward the position shown in FIG. 1, a shunt current path is established through the interrupter 20 via a connection with the stationary contact structure 18, through the internal interrupting contact structure to a shunt contact located at 24 in FIG. 1 on the outside of the interrupter 20. The shunt current path is completed to the moving contact structure 14 via an auxiliary contact 26 carried by the switch blade 16.

During opening and after the switch blade 16 has moved to the position of FIG. 1, the shunt current path through the interrupter 20 is interrupted internally within the interrupter 20 via actuation of the external trigger structure of the interrupter 20 by the switch-blade cam 22. In this way, interruption of the circuit occurs within the interrupter 20 via the internal interrupting contacts. Further movement during the opening operation moves the switch blade 16 passed the position of FIG. 1 in the direction 28. During switch closing operation in the direction 30, when the switch blade 16 moves through the position of FIG. 1 to bring the moving contact portion 17 into engagement with the stationary contact structure 18, the interrupter 20 is closed via actuation of the external trigger structure by the switch-blade cam 22. The illustrative switch 10 of FIG. 1 also includes arcing contacts 32 to absorb the brunt of any arcing that may take place during closing of the switch 10, i.e. the arcing contacts 32 performing a sacrificial function to prevent arcing between the switch-blade contact portion 17 and the stationary contact structure 18.

In accordance with important aspects of the present invention, the ice-protection arrangement 12 ensures that ice formations will not occur on the moving contact structure 14 that could interfere with appropriate closing operation of the switch 10, i.e. proper mating contact between the switch-blade contact portion 17 and the stationary contact structure 18. Additionally, the ice-protection arrangement 12 also ensures against ice formation on the switch-blade cam 22 that might interfere with operation of the switch 10, e.g. external trigger structure (not shown) on the interrupter 20.

Additionally, if the switch 10 includes the arcing contacts 32, ice formation is also prevented thereon.

In a specific embodiment, the ice-protection arrangement 12 includes a shield assembly 50 movably mounted about a pivot point 52 with respect to the switch blade 16. Specifically, the shield assembly 50 moves relatively to the switch blade 16 during operation of the switch 10 from the position 50' in FIG. 3 corresponding to the open position of the switch 10 to the position 50" corresponding to the closed position of the switch 10, an interim position 50'" also being illustrated in FIG. 3. The shield assembly 50 includes a cam 54 that interacts with the interrupter 20 at portion 34 to move the shield assembly 50 as shown in FIG. 1 which corresponds approximately to the interim position 50'" shown in FIG. 3, i.e. in FIG. 1, the shield assembly 50 has already been moved out of the position 50'. Thus, as the shield assembly 50 is moved during switch closing operation to the position 50", the operative engagement components of the moving contact structure 14 may freely engage with the stationary contact structure 18. For example, as shown in FIG. 3 and 4, the shield assembly 50 covers and protects the switch-blade cam 22, the switch-blade contact portion 17, and the arcing contacts 32 of the moving contact structure 14.

The shield assembly 50 is biased toward the protective position 50' corresponding to the switch opened position via a torsion spring 56 arranged to operate between the shield assembly 50 and the switch blade 16 and carried by a bolt 58. Thus, as the switch 10 is opened and moved away from the closed position, the shield assembly 50 moves from the position 50" relative to the switch-blade 16 to the position 50' protecting the components from ice formations.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

The invention claimed is:

1. An arrangement to protect an electrical switch from ice formation, the electrical switch having a moving contact structure and a stationary structure including a stationary contact structure, the arrangement comprising an ice shield that is carried by the moving contact structure and that is movable between opened and closed positions corresponding to respective closed and opened positions of the switch, the ice shield being engaged by the stationary structure of the switch when the moving contact structure is moved toward the closed position of the switch, the ice shield including a cam element for engagement with the stationary structure of the switch.

2. The arrangement of claim 1 further comprising means for movably mounting said ice shield with respect to the moving contact structure.

3. An arrangement to protect an electrical switch from ice formation, the electrical switch having a moving contact structure and a stationary structure including a stationary contact structure, the arrangement comprising an ice shield that is carried by the moving contact structure and that is movable between opened and closed positions corresponding to respective closed and opened positions of the switch, the ice shield being engaged by the stationary structure of the switch when the moving contact structure is moved toward the closed position of the switch, the moving contact structure including a switch blade, contact portions and switch actuation portions, said ice shield being positioned to cover the switch blade, contact portions and switch actuation portions when the moving contact structure is moved out of the switch closed position.

* * * * *